US010950969B2

(12) United States Patent
Wu et al.

(10) Patent No.: US 10,950,969 B2
(45) Date of Patent: Mar. 16, 2021

(54) GANGED COAXIAL CONNECTOR ASSEMBLY WITH ALTERNATIVE ATTACHMENT STRUCTURES

(71) Applicant: CommScope Technologies LLC, Hickory, NC (US)

(72) Inventors: JianPing Wu, Jiangsu (CN); Yujun Zhang, Jiangsu (CN); Jien Zheng, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 25 days.

(21) Appl. No.: 16/506,594

(22) Filed: Jul. 9, 2019

(65) Prior Publication Data

US 2020/0021055 A1 Jan. 16, 2020

(30) Foreign Application Priority Data

Jul. 11, 2018 (CN) ..... 201810753854.5

(51) Int. Cl.
*H01R 9/05* (2006.01)
*H01R 13/514* (2006.01)
(Continued)

(52) U.S. Cl.
CPC ..... *H01R 13/514* (2013.01); *H01R 13/622* (2013.01); *H01R 13/631* (2013.01);
(Continued)

(58) Field of Classification Search
CPC .. H01R 13/514; H01R 13/6276; H01R 24/38; H01R 24/40
(Continued)

(56) References Cited

U.S. PATENT DOCUMENTS 3,078,436 A * 2/1963 Berry ..... H01R 13/6588 439/579
3,551,874 A * 12/1970 Volinskie ..... H01R 24/542 439/63
(Continued)

OTHER PUBLICATIONS

Internatonal Search Report corresponding to International Application No. PCT/US2019/040918 dated Oct. 25, 2019.
(Continued)

*Primary Examiner* — Neil Abrams
(74) *Attorney, Agent, or Firm* — Myers Bigel, P.A.

(57) ABSTRACT

A ganged coaxial connector assembly comprises a male connector including: a male connector body; and a plurality of unit male connectors arranged in the male connector body, wherein each unit male connector includes an inner contact, an outer contact and a dielectric spacer. The ganged coaxial connector assembly further comprises a female connector including: a female connector body; and a plurality of unit female connectors arranged in the female connector body, wherein the number of the unit female connectors is the same as that of the unit male connectors, and each unit female connector corresponds to each unit male connector when the male connector and female connector are mated, and wherein each unit female connector includes an inner contact, an outer contact and a dielectric spacer. The female connector may be formed with structures for push-pull, ball and groove attachment or alternatively for threaded sleeve attachment.

20 Claims, 5 Drawing Sheets

(51) Int. Cl.

| | |
|---|---|
| ***H01R 24/40*** | (2011.01) |
| ***H01R 13/631*** | (2006.01) |
| ***H01R 13/639*** | (2006.01) |
| ***H01R 13/622*** | (2006.01) |
| *H01R 103/00* | (2006.01) |

(52) U.S. Cl.
CPC ..... *H01R 13/639* (2013.01); *H01R 24/40* (2013.01); *H01R 2103/00* (2013.01)

(58) Field of Classification Search
USPC ..... 439/579, 348
See application file for complete search history.

(56) References Cited

U.S. PATENT DOCUMENTS 3,582,867 A * 6/1971 Thompson ..... H01R 13/6453 439/362
3,701,083 A * 10/1972 Ziegler, Jr. ..... H01R 24/52 439/248
3,808,579 A * 4/1974 Mina ..... H01R 13/527 439/180
3,825,874 A * 7/1974 Peverill ..... H01R 24/568 439/579
3,852,700 A * 12/1974 Haws ..... H01R 13/6585 439/98
4,451,107 A * 5/1984 Dola ..... H01R 12/737 439/607.1
4,477,140 A * 10/1984 Espiritu ..... H01R 13/622 439/312
4,582,347 A * 4/1986 Wilcox ..... F16L 29/02 285/12
4,708,666 A * 11/1987 Fisher, Jr. ..... H01R 24/40 439/515
5,344,340 A * 9/1994 Bouleau ..... H01R 24/50 439/581
6,386,914 B1 * 5/2002 Collins ..... H01R 9/0527 439/579
7,601,028 B2 * 10/2009 Eckel ..... H01R 13/5202 439/579
7,934,952 B2 * 5/2011 Pera ..... H01R 24/52 439/578
8,070,533 B1 * 12/2011 Tai ..... H01R 13/6456 439/681
2006/0172571 A1 8/2006 Montena
2014/0368069 A1 12/2014 Ren
2015/0064957 A1 3/2015 Zhang et al.
2016/0190742 A1 6/2016 Jozwik et al.
2018/0138632 A1 5/2018 Qin et al.
2020/0021055 A1 * 1/2020 Wu ..... H01R 13/622

OTHER PUBLICATIONS

"International Preliminary Report on Patentability corresponding to International Application No. PCT/US2019/040918 dated Jan. 21, 2021".

* cited by examiner

GANGED COAXIAL CONNECTOR ASSEMBLY WITH ALTERNATIVE ATTACHMENT STRUCTURES

RELATED APPLICATION

The present application claims priority from and the benefit of Chinese Patent Application No. 201810753854.5, filed Jul. 11, 2018, the disclosure of which is hereby incorporated herein by reference in its entirety.

FIELD OF THE INVENTION

The present disclosure is directed generally to electrical cable connectors. More particularly, the present disclosure is directed to a ganged coaxial connector assembly.

BACKGROUND

Coaxial cables are commonly utilized in radio frequency communication systems. A typical coaxial cable includes an inner conductor, an outer conductor, a dielectric layer that separates the inner and outer conductors, and a jacket that covers the outer conductor. Coaxial connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic device or on another cable. Coaxial connector interfaces generally utilize a connecting nut or other retainer to pull the coaxial connector pairs together to achieve reliable electromechanical engagement.

In general, coaxial connectors can be classified into male connectors and female connectors by type. A typical male connector generally includes: an inner contact (generally a pin or post) for connection with the inner conductor of the cable; an outer contact circumferentially surrounding the inner contact and spaced apart from the inner contact, the outer contact being generally used for connection with an outer conductor of a mating connector; and a dielectric spacer arranged between the inner contact and the outer contact. A typical female connector has a structure similar to the male connector, but the inner contact of the female connector is a sleeve that receives the inner contact (a pin or post) of the male connector in an interference fit.

Currently there is also known a type of ganged coaxial connector that includes multiple unit coaxial connectors that are arranged as a single integrated unit. The existing ganged coaxial connector may have a complex structure, poor reliability, and serious passive intermodulation distortion (PIM), and thus may be improved.

SUMMARY

One of the objects of the present disclosure is to provide a ganged coaxial connector assembly capable of overcoming at least one of the defects in the prior art.

According to one aspect of the present disclosure, a ganged coaxial connector assembly is provided. The ganged coaxial connector assembly comprises a male connector including: a male connector body; and a plurality of unit male connectors arranged in the male connector body, wherein each unit male connector is configured as a 2.2-5 male connector interface and includes an inner contact, an outer contact and a dielectric spacer. The ganged coaxial connector assembly according to the present disclosure further comprises a female connector including: a female connector body; and a plurality of unit female connectors arranged in the female connector body, wherein the number of the unit female connectors is the same as that of the unit male connectors, and each unit female connector corresponds to each unit male connector when the male connector and female connector are mated, and wherein each unit female connector is configured as a 2.2-5 female connector interface and includes an inner contact, an outer contact and a dielectric spacer.

According to an embodiment of the present disclosure, the female connector body includes an external thread that enables the female connector body to threadly receive a coupling nut to secure the mating of the female connector body with the male connector body; and wherein the female connector body feature includes an external feature that enables the female connector body to receive a push-pull self-locking mechanism to secure the mating of the female connector body with the male connector body.

According to an embodiment of the present disclosure, the external feature is arranged on an outer surface of the female connector body and adjacent to a proximal end of the female connector, and wherein the external thread is closely adjacent to the external feature and extends toward the direction of a distal end.

According to an embodiment of the present disclosure, the external feature comprises an annular groove, and the external thread comprises multi-start thread.

According to an embodiment of the present disclosure, the female connector further comprises a guide pin, and the male connector further comprises a guide hole for receiving the guide pin when mated.

According to an embodiment of the present disclosure, both the guide pin and the guide hole have a cross section in the shape of an isosceles trapezoid.

According to an embodiment of the present disclosure, the ganged coaxial connector assembly further comprises a push-pull self-locking mechanism arranged on the male connector, and the push-pull self-locking mechanism includes: a cylindrical self-locking mechanism body arranged coaxially with the male connector body and radially spaced apart from the outer surface of the male connector body by a distance to form an annular gap between the self-locking mechanism body and the male connector body; a coupling sleeve at least partially covering the self-locking mechanism body; an annular slide block positioned in the annular gap; a first biasing member biasing the annular slide block toward the proximal end of the male connector; a second biasing member biasing the coupling sleeve toward the proximal end of the male connector; and at least one retaining member, each of which being respectively positioned in a respective pocket of the self-locking mechanism body and being capable of radial movement, the retaining member being configured to interact with the annular slide block and the coupling sleeve; wherein in an unmated state, the first biasing member forces the annular slide block to engage the retaining member, and the coupling sleeve is in a first position relative to the self-locking mechanism body; and wherein in a mated state, the female connector forces the annular slide block away from the retaining member, and the second biasing member forces the coupling sleeve against the retaining member and forces the coupling sleeve to be in a second position relative to the outer conductor body, and the second position is closer to the proximal end of the male connector than the first position.

According to an embodiment of the present disclosure, the retaining member is a ball.

According to an embodiment of the present disclosure, the first biasing member is a spring.

According to an embodiment of the present disclosure, the second biasing member is a spring.

According to an embodiment of the present disclosure, the annular slide block includes a recess in which the retaining member resides in the unmated state.

According to an embodiment of the present disclosure, the ganged coaxial connector assembly further comprises a threaded coupling mechanism arranged on the male connector, wherein an inner surface of the threaded coupling mechanism is provided with a multi-start thread which is used for securing the mating of the female connector body with the male connector body.

According to an embodiment of the present disclosure, the threaded coupling mechanism is connected to the male connector body by a snap ring.

According to an embodiment of the present disclosure, the multi-start thread is three-start thread or four-start thread.

According to another aspect of the present disclosure, a ganged coaxial connector assembly is provided. The ganged coaxial connector assembly comprises a male connector including: a male connector body; and a plurality of unit male connectors arranged in the male connector body, wherein each unit male connector includes an inner contact, an outer contact and a dielectric spacer. The ganged coaxial connector assembly according to the present disclosure further comprises a female connector including: a female connector body; and a plurality of unit female connectors arranged in the female connector body, wherein the number of the unit female connectors is the same as that of the unit male connectors, and each unit female connector corresponds to each unit male connector when the male connector and female connector are mated, and wherein each unit female connector includes an inner contact, an outer contact and a dielectric spacer. The female connector body includes an external thread that enables the female connector body to threadly receive a coupling nut to secure the mating of the female connector body with the male connector body; and the female connector body feature includes an external feature that enables the female connector body to receive a push-pull self-locking mechanism to secure the mating of the female connector body with the male connector body.

According to an embodiment of the present disclosure, the external feature comprises an annular groove.

According to an embodiment of the present disclosure, the external thread comprises multi-start thread.

BRIEF DESCRIPTION OF THE FIGURES

Many aspects of the present disclosure will be better understood after a reading of the following detailed description of the embodiments in combination with the accompanying drawings, wherein.

DETAILED DESCRIPTION

Figure 1:
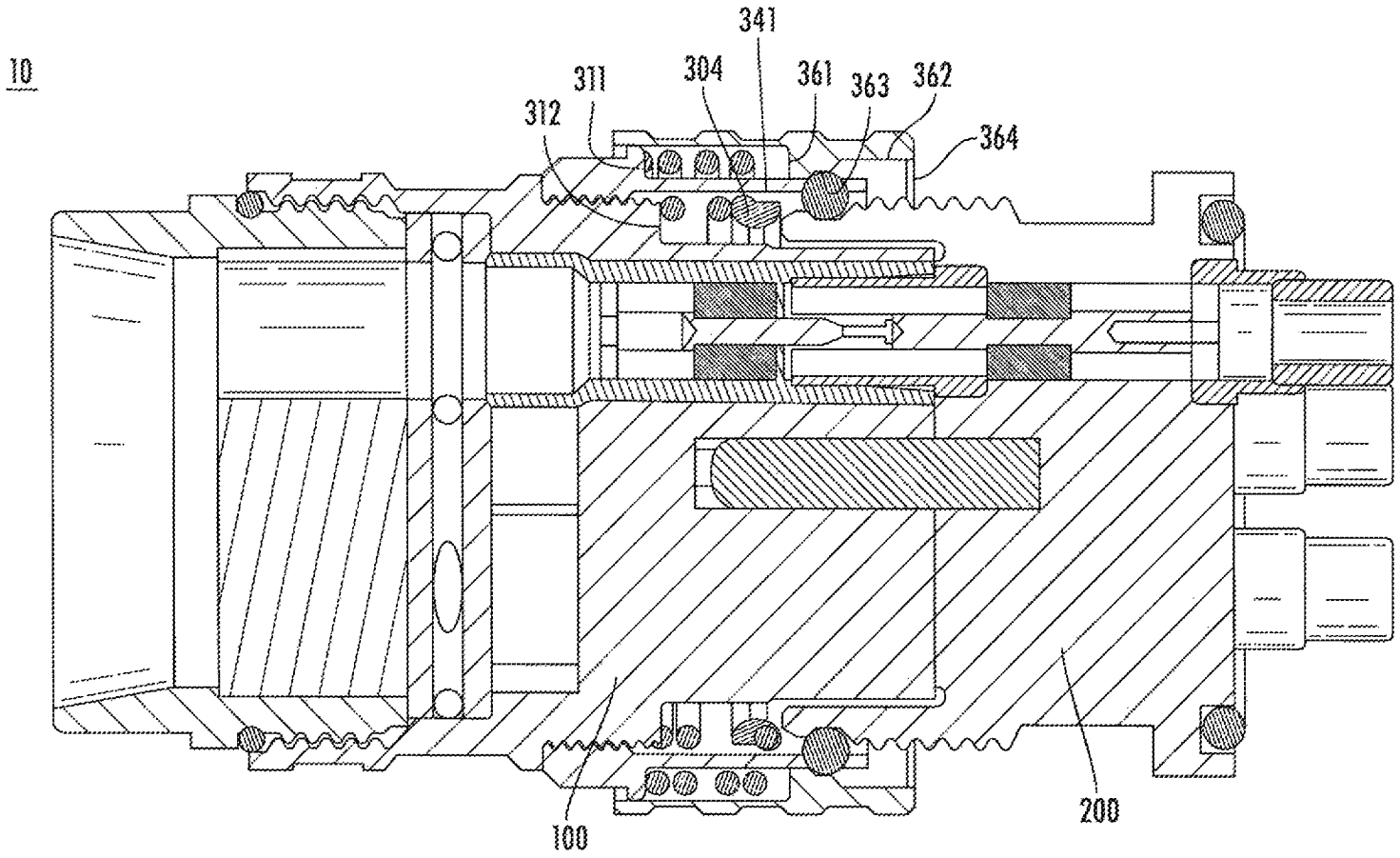
FIG. 1 is a section view of a ganged coaxial connector assembly according to one embodiment of the present disclosure.

The present disclosure will be described with reference to the accompanying drawings, in which certain embodiments of the present disclosure are shown. It should be understood, however, that the present disclosure may be presented in many different ways and is not limited to the embodiments described below. The embodiments described below are intended to make the disclosure of the present disclosure more complete and to fully convey the protection scope of the present disclosure to those skilled in the art. It should also be understood that, the embodiments disclosed herein can be combined in various ways to provide more additional embodiments.

It should be understood that, like reference signs indicate like elements throughout the drawings. In the drawings, the size of some features may be modified for clarity.

It should be understood that, the terminology used in the description is for the purpose of describing particular embodiments only and is not intended to limit the present disclosure. Unless otherwise defined, all terms (including technical and scientific terms) used in the description have the meaning as commonly understood by those skilled in the art. Well-known functions or constructions may not be described in detail for brevity and/or clarity.

The singular forms "a", "an", "said" and "the" used in the description all include the plural forms, unless clearly indicated otherwise. The terms "comprises", "comprising", "includes" and "including" used in the description specify the presence of stated features, but do not preclude the presence of one or more other features. The term "and/or" used in the description includes any and all combinations of one or more of the associated listed items. The terms "between X and Y" and "between about X and Y" used in the description should be interpreted to include X and Y. The term "between about X and Y" used in the description means "between about X and about Y", and the term "from about X to Y" used in the description means "from about X to about Y".

In the description, when an element is referred to as being "on", "attached" to, "connected" to, "coupled" to, "contacting", etc., another element, it can be directly on, attached to, connected to, coupled to or contacting the other element, or intervening elements may be present. In contrast, when an element is referred to as being "directly on", "directly attached" to, "directly connected" to, "directly coupled" to or "directly contacting" another element, there would be no intervening elements present. In the description, reference to a feature that is arranged "adjacent" another feature may have portions that overlap or above or below the adjacent feature.

In the description, spatially relative terms, such as "above", "below", "left", "right", "front", "rear", "high", "low" and the like, may describe one feature's relationship to another feature as illustrated in the drawings. It should be understood that the spatially relative terms are intended to encompass different orientations of the device in use or operation in addition to the orientation depicted in the drawings. For example, if the device in the drawings is inverted, features originally described as "below" other features would then be described as "above" other features. The device may be otherwise oriented (rotated 90 degrees or at other orientations) and relative spatial relationships used herein will be interpreted accordingly.

In the description, the ends of the male connector and the female connector facing each other when mated are defined as proximal ends, and the ends distant from each other are defined as distal ends.

Referring now to FIGS. 1-5, a ganged coaxial connector assembly according to one embodiment of the present disclosure is shown therein and is designated broadly at 10. The coaxial connector assembly 10 comprises a male connector 100 and a female connector 200. The male connector 100 includes a plurality of unit male connectors 120, and the female connector 200 includes a plurality of unit female connectors 220. The number of unit male connectors 120 is the same as that of unit female connectors 220 such that each of the unit male connectors corresponds to each of the unit female connectors when they are mated.

Figure 2:
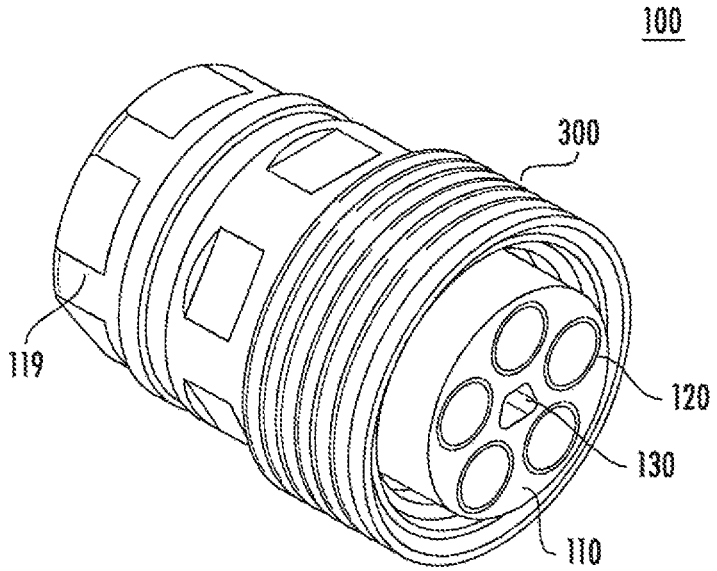
FIG. 2 is a perspective view of a male connector of the ganged coaxial connector assembly shown in FIG. 1.
Figure 3:
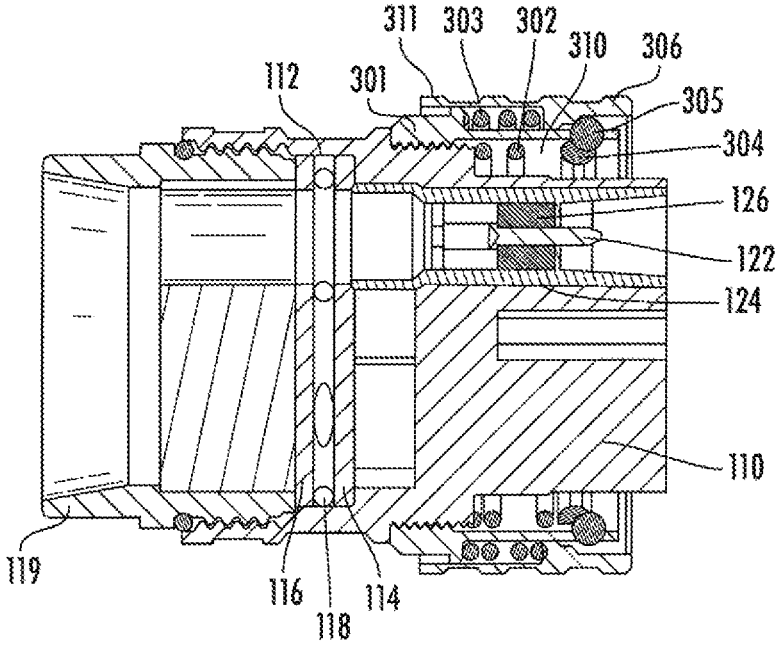
FIG. 3 is a section view of the male connector shown in FIG. 2.

Referring to FIGS. 2 and 3, the male connector 100 comprises a cylindrical male connector body 110. In the embodiment shown in FIG. 2, five unit male connectors 120 are arranged in the male connector body 110, and the axes of the five unit male connectors are arranged to be parallel and evenly circumferentially distributed, such that the axes of the five unit male connectors are spaced apart from each other by 72 degrees. According to actual requirements, other numbers of unit male connectors 120 may also be arranged in the male connector body 110, for example, four or six unit male connectors 120 may be provided.

In embodiments according to the present disclosure, each unit male connector 120 is directly inserted into a respective through hole provided in the male connector body 110. The proximal end of the unit male connector 120 is substantially flush with the proximal end of the male connector body 110. The distal end of male connector body 110 comprises an annular protrusion 112 in which two stop plates 114 and 116 are arranged. The stop plate 114 abuts the distal end of the unit male connector 120 to prevent the unit male connector 120 from moving. Sealing gaskets 118 are sandwiched between the two stop plates 114 and 116. The sealing gaskets 118 have functions of waterproofing, dustproofing, and the like. The sealing gaskets 118 may also allow a degree of axial "float" to the unit male connectors to compensate for any axial misalignment of the unit male connectors 120.

The unit male connector 120 may also be arranged in the male connector body 110 by otherways. For example, the unit male connector 120 may be arranged in the male connector body by means of threaded connection, welding, or the like. The unit male connector 120 or a portion thereof (e.g., an outer contact thereof) may also be integrally formed with the male connector body 110.

The male connector 100 may also comprise a threaded sleeve 119. The threaded sleeve 119 is threadly connected and fixed to the inner surface of the annular protrusion 112. The threaded sleeve 119 may constrain a plurality of cables (not shown) connected to the male connector 100. In addition, the proximal end of the threaded sleeve 119 abuts the stop plate 116 and can serve to fix the stop plate 116.

Figure 4:
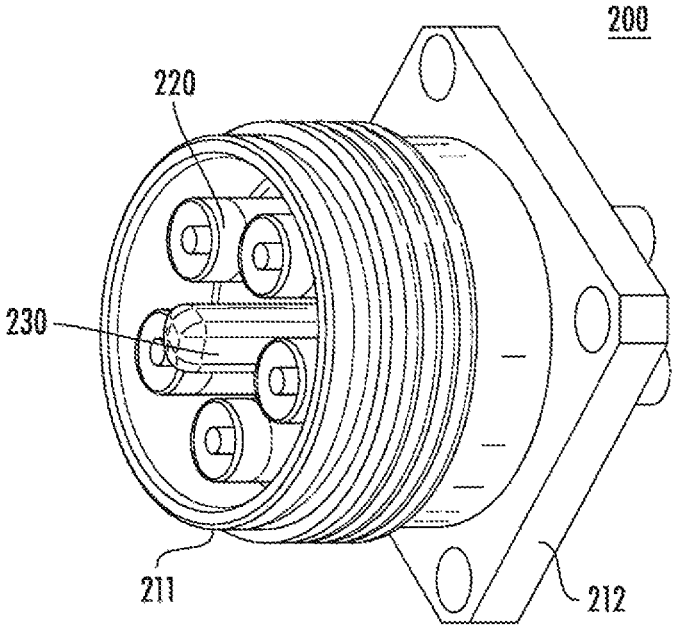
FIG. 4 is a perspective view of a female connector of the ganged coaxial connector assembly shown in FIG. 1.
Figure 5:
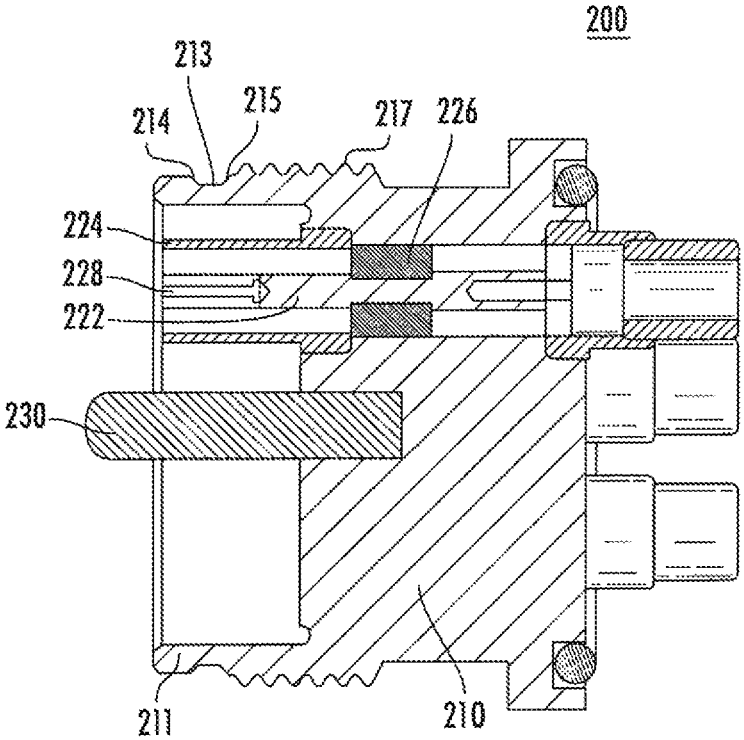
FIG. 5 is a section view of the female connector shown in FIG. 4.

Referring next to FIGS. 4 and 5, the female connector 200 comprises a cylindrical female connector body 210. The plurality of unit female connectors 220 are arranged in the female connector body 210. The number and arrangement of the unit female connectors 220 are the same as those of the unit male connectors 120, such that the each of the unit female connectors could correspond to each of the unit male connectors when they are mated.

The unit female connectors 220 may be arranged in the female connector body 210 in various ways. For example, each unit female connector 220 may be directly inserted into a respective through hole provided in the female connector body 210 by an interference fit. Each unit female connector 220 may also be arranged in the female connector body 210 by means of threaded connection, welding, or the like.

The proximal end of the female connector body 210 is provided with an annular protrusion 211 that surrounds the plurality of unit female connectors 220 of the female connector 200. The free end (i.e., the extends proximal end) of the annular protrusion 211 is substantially flush with or slightly beyond the proximal end of each unit female connector 220. An annular groove 213 is provided on the outer surface of the annular protrusion 211, and is located near the free end of the annular protrusion 211. The annular groove 213 has inclined surfaces 214 and 215.

In one embodiment according to the present disclosure, the female connector 200 is configured as a panel-mounted female connector. In this embodiment, the distal end of the female connector body 210 is provided with a fixing panel 212 in a square or rectangular shape. The fixing panel 212 may be used to fix the female connector 200 to other devices or components.

Both the annular protrusion 211 and the fixing panel 212 may be integrally formed with the female connector body 210 (e.g., formed by machining the female connector body 210), or may be formed as separate components.

To facilitate the mating of the male connector 100 and the female connector 200, as shown in FIGS. 4 and 5, the female connector 200 may comprise a guide pin 230. The guide pin 230 may be arranged at the central position of the female connector body 210 and extend toward the proximal end along the axial direction of the female connector body 210. Accordingly, as shown in FIGS. 2 and 3, the male connector 100 may comprise a guide hole 130 for receiving the guide pin 230. Similarly, the guide hole 130 may also be arranged at the central position of the male connector body 110 such that each of the unit male connectors 110 of the male connector 100 could correspond to each of the unit female connectors 210 of the female connector 200 when the guide pin 230 is inserted into the guide hole 130. However, the present disclosure is not limited thereto, and the guide pin 230 and the guide hole 130 may be arranged at any suitable position.

As can be more clearly seen from FIG. 5, the free end of the guide pin 230 extends beyond the free end of the annular protrusion 211. In this way, when the male connector 100 is mating with the female connector 200, the free end of the guide pin 230 may be first inserted into the guide hole 130 of the male connector 100 such that each unit male connector 120 can easily and correctly mate with each unit female connector 220.

In embodiments according to the present disclosure, as shown in FIGS. 2 and 4, the guide pin 230 and the guide hole 130 have a cross section in the shape of an isosceles trapezoid. Referring to FIG. 2, the upper edge of the isosceles trapezoidal guide hole 130 corresponds to one unit male connector 120, and the four corners of the isosceles trapezoidal guide hole 130 substantially correspond to the other four unit male connectors 120, respectively. In the case where four unit connectors are provided, the four sides of the isosceles trapezoid may substantially correspond to the four unit connectors, respectively. Such an arrangement can easily achieve accurate mating of the unit male connectors 120 and the unit female connectors 220 and prevent misinsertion. The use of isosceles trapezoidal guide pin and guide hole is particularly advantageous for a ganged connector provided with four or five unit connectors. In addition, the isosceles trapezoidal guide pin and guide hole will be more easily machined than other shapes.

Further, the proximal end of the guide pin 230 may be rounded or tapered so that it can be smoothly inserted into the guide hole 130.

In the ganged coaxial connector assembly 10 according to embodiments of the present disclosure, the unit male connectors 120 and the unit female connectors 220 are each configured as a miniaturized 2.2-5 (male/female) connector interface. The 2.2-5 connector interface is similar to the 4.3-10 connector interface that meets IEC standards (such as IEC 61169-54) in term of structure, but only about half of the latter in term of size. Specifically, the outer diameter of the inner contact of the 2.2-5 connector interface is nominally 2.2 mm, and the inner diameter of the outer contact is nominally 5.00 mm. That is, the nominal radio frequency mating sizes for the 2.2-5 connector interface are about 2.2 mm (for inner contact) and about 5.00 mm (for outer contact), respectively. Like the 4.3-10 connector interface, the mechanical reference plane and the electrical reference plane of the outer conductor are two separate planes.

Referring to FIG. 3, the unit male connector 120 configured as a 2.2-5 connector interface comprises an inner contact 122, an outer contact 124, and a dielectric spacer 126. The inner contact 122 has a pin or post with a conical proximal end and is configured to be attached to the inner conductor of the coaxial cable at its distal end. The outer contact 124 has a cylindrical shape, and the inner surface of the proximal end thereof is beveled to facilitate the insertion of the unit female connector 220. The dielectric spacer 126 (which is in an annular shape) is positioned between the inner contact 122 and the outer contact 124 so that the inner contact 122 and the outer contact 124 are dielectrically isolated.

Referring to FIG. 5, the unit female connector 220 configured as a 2.2-5 connector interface comprises an inner contact 222, an outer contact 224, and a dielectric spacer 226. The proximal end of the inner contact 222 is hollow, forming a cavity 228 for receiving the inner contact 122 of the unit male connector 120. The distal end of the inner contact 222 is configured to be attached to and be in electrical contact with the inner conductor of a second coaxial cable. The outer conductor 224 has a cylindrical shape and comprises a plurality of resilient fingers (see FIG. 4). The dielectric spacer 226 is positioned between the inner contact 222 and the outer contact 224 so that the inner contact 222 and the outer contact 224 are dielectrically isolated.

The unit male connectors 120 and the unit female connectors 220 configured as 2.2-5 connector interfaces may have the following advantages:

- About 50% of space is saved compared to 4.3-10 connector interfaces;
- They have better robustness and reliability;
- They have very low passive intermodulation distortion (PIM), and the PIM may be lower than −166 dBc;
- The electrical characteristics are not affected by the tightening torque.

Accordingly, the ganged coaxial connector assembly 10 according to the embodiments of the present disclosure not only maintains the above-mentioned advantages of a single 2.2-5 connector interface, but also occupies less space and realizes the miniaturization of the ganged coaxial connector assembly. At the same time, the ganged coaxial connector assembly 10 may have in general superior electromechanical characteristics (for example, very low PIM) and reliability compared to the existing ganged connector assembly.

Referring back to FIGS. 1-3, in one embodiment according to the present disclosure, the ganged coaxial connector assembly 10 uses a push-pull self-locking mechanism 300 to maintain the engagement of the male connector 100 and the female connector 200. As shown in FIGS. 2 and 3, the push-pull self-lock mechanism 300 may be arranged on the male connector 100. The push-pull self-locking mechanism 300 comprises a cylindrical self-locking mechanism body 301 that can be connected to the male connector body 110 of the male connector 100 by means of threaded connection or the like. The self-locking mechanism body 301 is arranged coaxially with the male connector body 110 and is radially spaced from the outer surface of the male connector body 110 by a distance (for example, by providing a shoulder 312 on the outer periphery of the male connector body 110, see FIG. 1), so that an annular gap 310 is formed between the inner surface of the self-locking mechanism body 301 and the outer surface of the male connector body 110. An inner spring 302 is located in the annular gap 310. One end of the inner spring 302 abuts the shoulder 312, and the other end abuts an annular slide block 304 arranged within the annular gap 310. Four retaining members 305 (which are balls in the disclosed embodiments) are positioned in the pockets in the self-locking mechanism body 301 near the proximal end. The annular slide block 304 has a recess 341 (see FIG. 1) in its outer surface, and the recess contacts the ball 305.

A shoulder 311 is provided on the outer surface of the self-locking mechanism body 301 near the distal end of the self-locking mechanism body 301. An outer spring 303 surrounds the outer surface of the self-locking mechanism body 301. A coupling sleeve 306 is provided outside the outer spring 303. The coupling sleeve 306 at least partially covers the self-locking mechanism body 301. The inner surface of the coupling sleeve 306 is provided with a shoulder 361 that is near the proximal end of the coupling sleeve 306 (see FIG. 1). An annular cavity for receiving the outer spring 303 is formed between the shoulder 311 and the shoulder 361. One end of the outer spring 303 abuts the shoulder 311 and the other end abuts the shoulder 361.

Referring to FIG. 1, a first annular undercut 362 and a second annular undercut 363 are provided on the inner surface of the proximal end of the coupling sleeve 306. The first annular undercut 362 and the second annular undercut 363 are configured to receive the balls 305. The diameter of the first annular undercut 362 is greater than the diameter of the second annular undercut 363. An inclined transition 364 is provided between the first annular undercut 362 and the second undercut 363.

In the unmated state (FIG. 3), the coupling sleeve 306 is in a first position relative to the self-locking mechanism body 301, such that the balls 305 are received in the first annular undercut 362 of the coupling sleeve 306. In this first position, the outer spring 303 is compressed between the shoulder 311 of the self-locking mechanism body 301 and the shoulder 361 of the coupling sleeve 306. The inner spring 302 applies a slight biasing force on the slide block 304, such that the balls 305 are received in the recess 341 of the slide block 304.

Referring to FIG. 1, when the male connector 100 is mating with the female connector 200, the male connector 100 and the female connector 200 are moved toward each other in the axial direction. The annular protrusion 211 of the female connector 200 enters the annular gap 310 of the male connector 100, contacts the slide block 304, and forces the slide block 304 to move toward a direction compressing the inner spring 302 and away from the ball 305. When the slide block 304 moves away from the ball 305, the ball 305 can move radially inwardly. In this process, the coupling sleeve 306 is also moved toward the proximal end relative to the self-locking mechanism body 301 with the aid of pushing of the outer spring 303, so as to force the ball 305 to move radially inwardly by means of the inclined transition 364 between the first annular undercut 362 and the second annular undercut 363. The female connector 200 continues to move within the annular gap 310 of the male connector 100 until the ball 305 is received in the annular groove 213 of the female connector 200 and in the second annular undercut 363 of the coupling sleeve 306. At this time, the coupling sleeve 306 is moved to a second position, and the ball 305 is pressed between the annular groove 213 of the female connector 200 and the second annular undercut 363 of the coupling sleeve 306 so as to form a solid connection between the male connector 100 and the female connector 200.

When it is intended to disconnect the male connector 100 and the female connector 200, the coupling sleeve 306 and the male connector 100 are pulled in a direction toward the distal end, the coupling sleeve 306 is pulled from the second position to the first position, such that the first annular undercut 362 of the coupling sleeve 306 is moved to the position where the ball 305 is located. At this point, the ball 305 is free to move radially outwardly. The coupling sleeve 306 and the male connector 100 continue to be pulled such that the ball 305 is moved out of the annular groove 213 along the inclined surface 214. At the same time, the slide block 304 is moved toward the proximal end by the push of the inner spring 301 and finally moved to the position where the ball 305 is located, such that the ball 305 is received in the recess 341 of the slide block 304. The self-locking mechanism 300 returns to the unmated state, and the male connector 100 is disconnected from the female connector 200.

According to the above description, it can be seen that the self-locking mechanism 300 achieves the mating of the male connector 100 and the female connector 200 by a "push-pull" action rather than a rotation/screwing action. This way is simpler and quicker than traditional threaded connection. Therefore, the self-locking mechanism 300 may be referred to as a push-pull quick self-locking mechanism.

Those skilled in this art will appreciate that other self-locking mechanisms, such as those shown in U.S. Pat. Nos. 6,709,289; 6,692,286; 8,496,495; and 6,645,011, the disclosures of which are hereby incorporated herein by reference in full, may be suitable for use with the connectors discussed herein.

Figure 6:
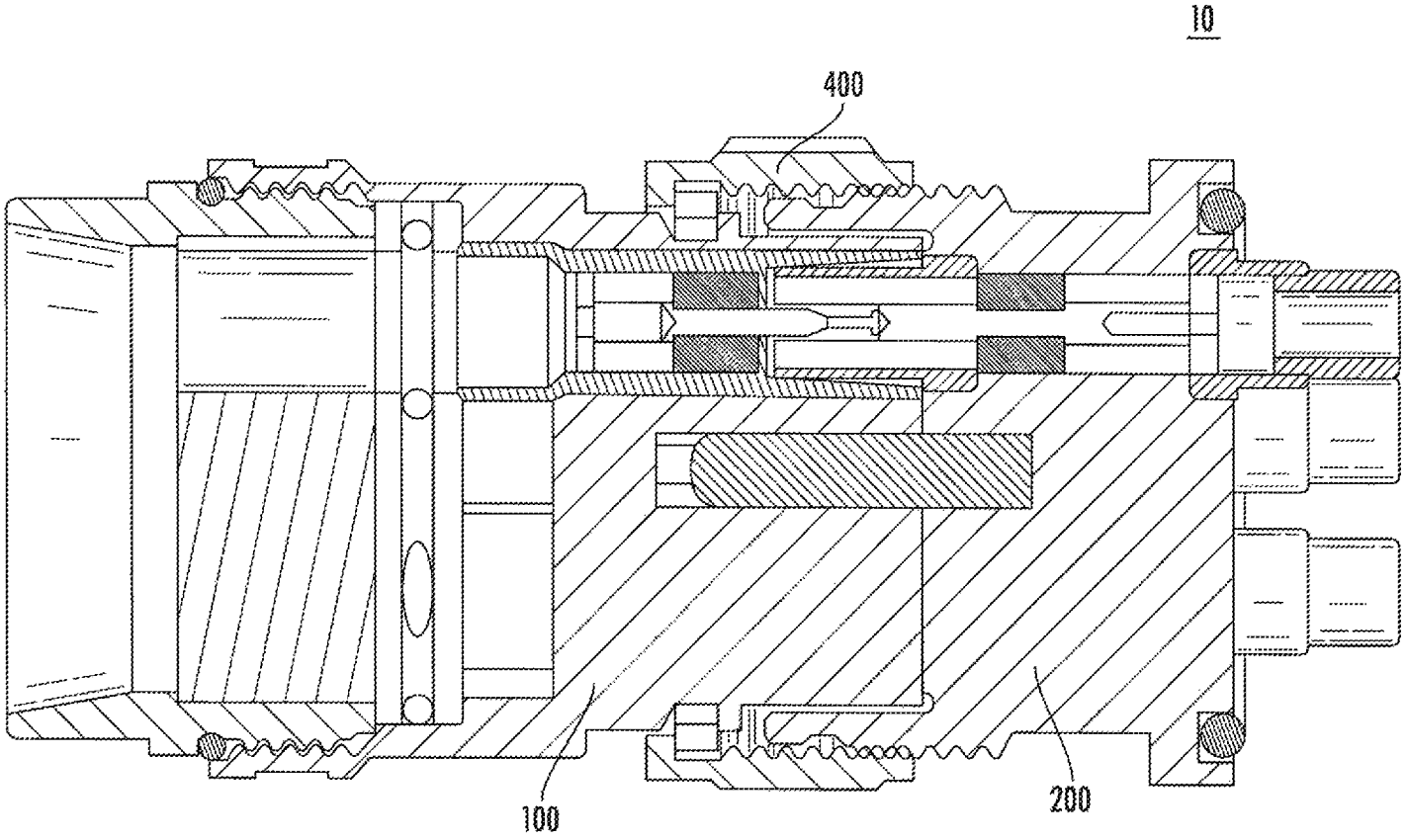
FIG. 6 is a section view of a ganged coaxial connector assembly according to another embodiment of the present disclosure.
Figure 7:
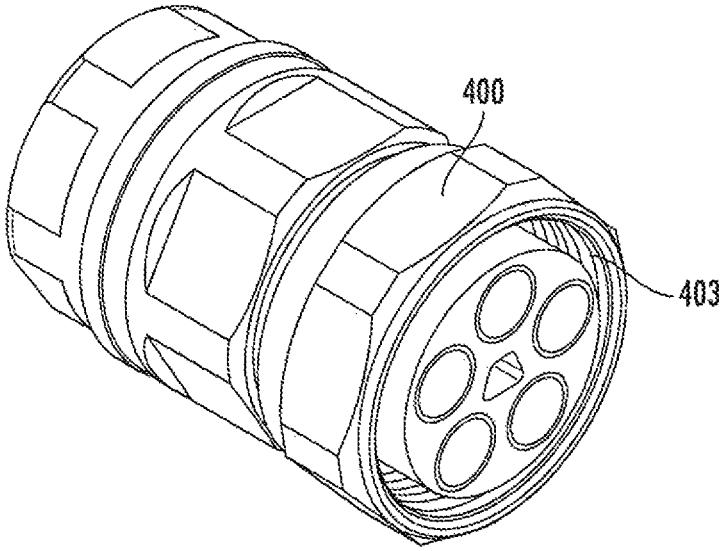
FIG. 7 is a perspective view of a male connector of the ganged coaxial connector assembly shown in FIG. 6.
Figure 8:
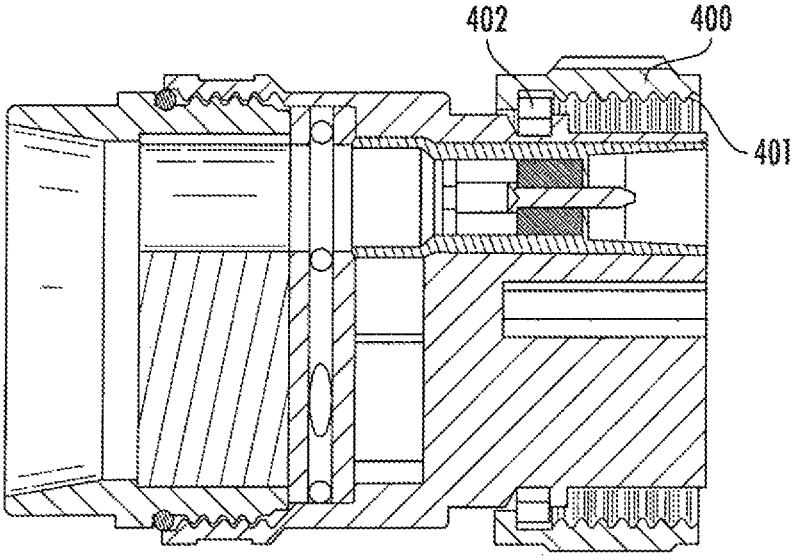
FIG. 8 is a section view of the male connector shown in FIG. 7.

Referring to FIGS. 6 to 8, another embodiment according to the present disclosure is shown. In this embodiment, the ganged coaxial connector assembly 10 uses a threaded coupling mechanism 400 to maintain the connection between the male connector 100 and the female connector 200.

As shown in FIGS. 7 and 8, the threaded coupling mechanism 400 has a cylindrical shape, and a multi-start thread 401 is provided on the inner surface thereof. The threaded coupling mechanism 400 is connected to the outer surface of the male connector body 110 of the male connector 100 by a snap ring 402 and is spaced apart from the outer surface of the male connector body 110 by a distance, so that an annular gap 403 is formed between the inner surface of the threaded coupling mechanism 400 and the outer surface of the male connector body 110. When the male connector 100 is mated with the female connector 200, the annular gap 403 serves to receive the annular protrusion 211 of the female connector 200.

On the outer surface of the annular protrusion 211 of the female connector 200, a mating multi-start thread 217 that is used to mate with the multi-start thread 401 of the threaded coupling mechanism 400 is provided. The multi-start thread 401 and the mating multi-start thread 217 may be three-start threads or four-start threads. The use of multi-start threads can save the time for mating the male connector 100 and the female connector 200, and thus achieve quick mating of the male connector 100 and the female connector 200. When three-start threads are used, 66% of the mating time can be saved; when four-start threads are used, 75% of the mating time can be saved.

In the embodiment shown in FIG. 5, both the annular groove 213 and the mating multi-start thread 217 are arranged on the outer surface of the protrusion 211 of the female connector 200. The annular groove 213 is arranged near the proximal end of the protrusion 211, and the mating multi-start thread 217 is closely adjacent to the annular groove 213 and extends toward the direction of the distal end. In this way, the female connector 200 is able to mate with a male connector 100 having a push-pull self-locking mechanism 300, and also able to mate with a male connector 100 having a threaded coupling mechanism 400, thus improving the universality of the female connector 200.

Those skilled in this art will appreciate that, although unit connectors meeting the 2.2/5 interface are shown herein, unit connectors with other interface configurations, such as NEX 10, 4.3/10 or the like, may also benefit from the concepts discussed herein.

Although exemplary embodiments of the present disclosure have been described, those skilled in the art should understand that various variations and modifications can be made to the exemplary embodiments of the present disclosure without materially departing from the spirit and scope of the present disclosure. Accordingly, all such variations and modifications are intended to be included within the protection scope of the present disclosure as defined in the claims. The present disclosure is defined by the appended claims, with equivalents of the claims to be included therein.

That which is claimed is:

1. A ganged coaxial connector assembly, comprising:

a male connector comprising:

a male connector body; and a plurality of unit male connectors arranged in the male connector body, wherein a proximal end of each unit male connector is substantially flush with a proximal end of the male connector body, and wherein each unit male connector is configured as a 2.2-5 male connector interface and includes an inner contact, an outer contact and a dielectric spacer;

a female connector comprising:

a female connector body; and a plurality of unit female connectors arranged in the female connector body, wherein the number of the unit female connectors is the same as that of the unit male connectors, and each unit female connector corresponds to each unit male connector when the male connector and female connector are mated, and wherein each unit female connector is configured as a 2.2-5 female connector interface and includes an inner contact, an outer contact and a dielectric spacer.

2. The ganged coaxial connector assembly according to claim 1, wherein the female connector body includes an external thread that enables the female connector body to threadly receive a coupling nut to secure the mating of the female connector body with the male connector body; and wherein the female connector body feature includes an external feature that enables the female connector body to receive a push-pull self-locking mechanism to secure the mating of the female connector body with the male connector body.

3. The ganged coaxial connector assembly according to claim 2, wherein the external feature is arranged on an outer surface of the female connector body and adjacent to a proximal end of the female connector, and wherein the external thread is closely adjacent to the external feature and extends toward the direction of a distal end.

4. The ganged coaxial connector assembly according to claim 3, wherein the external feature comprises an annular groove, and the external thread comprises multi-start thread.

5. The ganged coaxial connector assembly according to claim 1, wherein the female connector further comprises a guide pin, and the male connector further comprises a guide hole for receiving the guide pin when mated.

6. The ganged coaxial connector assembly according to claim 5, wherein both the guide pin and the guide hole have a cross section in the shape of an isosceles trapezoid.

7. A ganged coaxial connector assembly, comprising:

a male connector comprising:

a male connector body; and a plurality of unit male connectors arranged in the male connector body, wherein each unit male connector is configured as a 2.2-5 male connector interface and includes an inner contact, an outer contact and a dielectric spacer;

a female connector comprising:

a female connector body; and a plurality of unit female connectors arranged in the female connector body, wherein the number of the unit female connectors is the same as that of the unit male connectors, and each unit female connector corresponds to each unit male connector when the male connector and female connector are mated, and wherein each unit female connector is configured as a 2.2-5 female connector interface and includes an inner contact, an outer contact and a dielectric spacer; and a push-pull self-locking mechanism arranged on the male connector, the push-pull self-locking mechanism including:

a cylindrical self-locking mechanism body arranged coaxially with the male connector body and radially spaced apart from the outer surface of the male connector body by a distance to form an annular gap between the self-locking mechanism body and the male connector body;

a coupling sleeve at least partially covering the self-locking mechanism body;

an annular slide block positioned in the annular gap;

a first biasing member biasing the annular slide block toward the proximal end of the male connector;

a second biasing member biasing the coupling sleeve toward the proximal end of the male connector;

at least one retaining member, each of which being respectively positioned in a respective pocket of the self-locking mechanism body and being capable of radial movement, the retaining member being configured to interact with the annular slide block and the coupling sleeve;

wherein in an unmated state, the first biasing member forces the annular slide block to engage the retaining member, and the coupling sleeve is in a first position relative to the self-locking mechanism body; and wherein in a mated state, the female connector forces the annular slide block away from the retaining member, and the second biasing member forces the coupling sleeve against the retaining member and forces the coupling sleeve to be in a second position relative to the outer conductor body, and the second position is closer to the proximal end of the male connector than the first position.

8. The ganged coaxial connector assembly according to claim 7, wherein the retaining member is a ball.

9. The ganged coaxial connector assembly according to claim 7, wherein the first biasing member is a spring.

10. The ganged coaxial connector assembly according to claim 7, wherein the second biasing member is a spring.

11. The ganged coaxial connector assembly according to claim 7, wherein the annular slide block includes a recess in which the retaining member resides in the unmated state.

12. The ganged coaxial connector assembly according to claim 1, further comprising a threaded coupling mechanism arranged on the male connector, wherein an inner surface of the threaded coupling mechanism is provided with a multi-start thread which is used for securing the mating of the female connector body with the male connector body.

13. The ganged coaxial connector assembly according to claim 12, wherein the threaded coupling mechanism is connected to the male connector body by a snap ring.

14. The ganged coaxial connector assembly according to claim 12, wherein the multi-start thread is three-start thread or four-start thread.

15. A ganged coaxial connector assembly, comprising:

a male connector comprising:

a male connector body; and a plurality of unit male connectors arranged in the male connector body, wherein a proximal end of each unit male connector is substantially flush with a proximal end of the male connector body, and wherein each unit male connector includes an inner contact, an outer contact and a dielectric spacer;

a female connector comprising:

a female connector body; and a plurality of unit female connectors arranged in the female connector body, wherein the number of the unit female connectors is the same as that of the unit male connectors, and each unit female connector corresponds to each unit male connector when the male connector and female connector are mated, and wherein each unit female connector includes an inner contact, an outer contact and a dielectric spacer;

wherein the female connector body includes an external thread that enables the female connector body to threadly receive a coupling nut to secure the mating of the female connector body with the male connector body; and wherein the female connector body feature includes an external feature that enables the female connector body to receive a push-pull self-locking mechanism to secure the mating of the female connector body with the male connector body.

16. The ganged coaxial connector assembly according to claim 15, wherein the external feature is arranged on an outer surface of the female connector body and adjacent to a proximal end of the female connector, and wherein the external thread is closely adjacent to the external feature and extends toward the direction of a distal end.

17. The ganged coaxial connector assembly according to claim 15, wherein the external feature comprises an annular groove.

18. The ganged coaxial connector assembly according to claim 15, wherein the external thread comprises multi-start thread.

19. The ganged coaxial connector assembly according to claim 15, wherein the female connector further comprises a guide pin, and the male connector further comprises a guide hole for receiving the guide pin when mated.

20. The ganged coaxial connector assembly according to claim 19, wherein both the guide pin and the guide hole have a cross section in the shape of an isosceles trapezoid.

* * * * *